United States Patent [19]

Kinder

[11] 4,306,187

[45] Dec. 15, 1981

[54] APPARATUS FOR VISUALLY MONITORING IGNITION VOLTAGES

[76] Inventor: Joseph C. Kinder, 4323 N. Kenosha, Tulsa, Okla. 74106

[21] Appl. No.: 100,031

[22] Filed: Dec. 4, 1979

[51] Int. Cl.[3] ..... F02P 17/00

[52] U.S. Cl. ..... 324/395; 324/402

[58] Field of Search ..... 324/395, 397, 402

[56] References Cited

U.S. PATENT DOCUMENTS

| | | | |
|---|---|---|---|
| 1,976,988 | 10/1934 | Grangier et al. | 324/395 |
| 2,762,977 | 9/1956 | Krueger, Sr. | 324/395 X |
| 3,205,434 | 9/1965 | Fortune | 324/395 |
| 3,261,008 | 7/1966 | Schreter et al. | 324/395 X |
| 3,310,733 | 3/1967 | Fortune | 324/395 |
| 3,806,796 | 4/1974 | Goldstein | 324/397 X |

*Primary Examiner*—Stanley T. Krawczewicz
*Attorney, Agent, or Firm*—Head & Johnson

[57] ABSTRACT

A self-contained device for mounting on a motor vehicle, having an internal combustion engine, by means of which the ignition voltages at the spark plugs can be visually monitored by selecting any one of a number of switch points on a manual switch, to connect to a voltage divider at each of the spark plug terminals, by means of which a reduced value of the voltage on the selected device, which will produce a light pulse in synchronism with the occurance of the electrical sparking pulse supplied to the spark plug. The brightness or intensity of the light pulses present, for each of the voltage pulses impressed on the gaseous conduction device, are indicators of the operation of the ignition system.

4 Claims, 3 Drawing Figures

APPARATUS FOR VISUALLY MONITORING IGNITION VOLTAGES

BACKGROUND OF THE INVENTION

1. Field of the Invention

This invention lies in the field of ignition systems for motor vehicles. More particularly, it concerns a self-contained device by means of which the operator of a motor vehicle may selectively check the potential appearing at the gaps of the spark plugs, while the engine is running, to determine the condition of the ignition system.

2. Description of the Prior Art

It is well known that the spark plug in the internal combustion engine provides the sparks necessary to ignite and burn the air-fuel mixture compressed in the cylinder of the engine. It is well known also that the efficiency of the ignition system in igniting the air-fuel mixture, synchronously, with the piston movement, can be affected seriously by many factors, concerning the ignition potential generating means, or the wiring of the ignition system, or the condition of the spark plugs. For example if the spark plug has deposits of carbon over the surface of the insulator of the high potential electrode, there will be conduction of current to ground through the surface layer of carbon, which will diminish the magnitude of the potential applied to the spark gap. This can delay or alter the intensity of the spark, to the point where engine failures may occur.

Furthermore there are strict requirements as to the gap length of the spark gap and other factors which if not adhered to will provide a less efficient spark generation and ignition.

If an operator of a motor vehicle finds his engine running "roughly", it may be due to the failure of one or more spark plugs in the system, or in the wiring, or in the distributor, etc. Failure of one spark plug to ignite properly on each cycle can cause loss of efficiency and waste of fuel and other undesired effects.

In motor vehicle garages and service agencies, they have expensive and complicated machines that can be applied to the engine, and to the ignition system, to diagnose such "rough" conditions of the engine. However, as a prompt and simple test to determine which, if any, of the spark plugs are faulty or whether it is in wiring, etc, there are no means available on the market for a operator to make this determination. Of course, he may stop the car, and individually check the spark plugs by removing them, or check for the presence of sparking potential by removing the conducter from the tip of the spark plug, and determining, when the engine is restarted, whether a spark is passing to that spark plug.

The device of this invention solves these problems by providing a very simple switch-controlled mechanism for checking visually the voltage applied on each spark pulse, to each of the spark plugs.

SUMMARY OF THE INVENTION

It is the primary object of this invention to provide a simple self-contained intstrument that can be mounted on or near the dash of a motor vehicle whereby while the engine is running, the operator can switch from one point to another, and by observing the pulses of light which are emitted by the gaseous conduction device can determine qualitatively the magnitude of the potential appearing at the terminal of the spark plug. He can then determine whether this magnitude is satisfactory whether it is constant with time, and so on.

These and other objects are realized and the limitations of the prior art are overcome in this invention, by providing for installation on the motor vehicle of a device for selectively checking, visually, the sequential voltages which are applied to the spark plugs on the engine.

A manual switch is provided which can be attached to the dash board of the motor vehicle, and comprises a movable contact, which can be positioned on any one of a number of fixed contacts. A voltage divider, such as a pair of series resistors, is connected at one end to an adaptor connector, which can be installed on the terminal of the spark plug, and permit passage through the adaptor of the sparking voltage from the distributor, through the distribution wires, to the conventional connector, which attaches to the terminal of the spark plug. The second end of the voltage divider is connected to ground. The intermediate terminal which receives the divided voltage, is connected by an insulated conductor to one of the fixed contacts of the switch. One fixed contact is provided for each of the spark plugs in each of the cylinders of the engine.

When the engine is running and the operator wants to make the check, he simply switches the movable contact to a selected spark plug, and watches the sequential light pulses that appear on the gaseous discharge device. If the pulses of light are sequentially continuous and if they all appear to have the same brightness and if the magnitude of the brightness corresponds to the proper voltage, then that spark plug is deemed to be operating properly. However, if the brightness of the light pulses varies from time to time or is absent occasionally, that would indicate a failure, somewhere, to provide the proper voltage. If the brightness of the spark plug is overly high that would indicate that the spark is not firing because the presence of the spark would cause the voltage to drop and the pulse brightness would not be a maximum when the engine was operating properly.

An additional device can be added to this system, which comprises an electronic oscillator, of conventional design, that would put out a sequence of pulses of a selected magnitude, such that when the movable contact of the switch was connected to the terminal which connects to the oscillator, the brightness of the light pulse would be that corresponding to the optimum operation of the spark plug. Thus, the operator can frequently turn back to the oscillator contact to determine just what the visual effect of the proper voltage would be. Then he can make a judgment as to the magnitude of the individual sparking potentials.

Instead of connecting each of the multiple insulating wire from the switch to each of the spark plugs, an adaptor can be provided for mounting on the distributor. This adaptor would contain all of the multiple voltage dividers connected in a star connection, one end of each of the dividers going to one of the output leads of the distributor, and the center connection, of the star, going to ground.

BRIEF DESCRIPTION OF THE DRAWINGS

These and other objects and advantages of this invention and a better understanding of the principles and details of the invention will be evident from the following description, taken in conjunction with the appended drawings, in which.

DESCRIPTION OF THE PREFERRED EMBODIMENT

Figure 1:
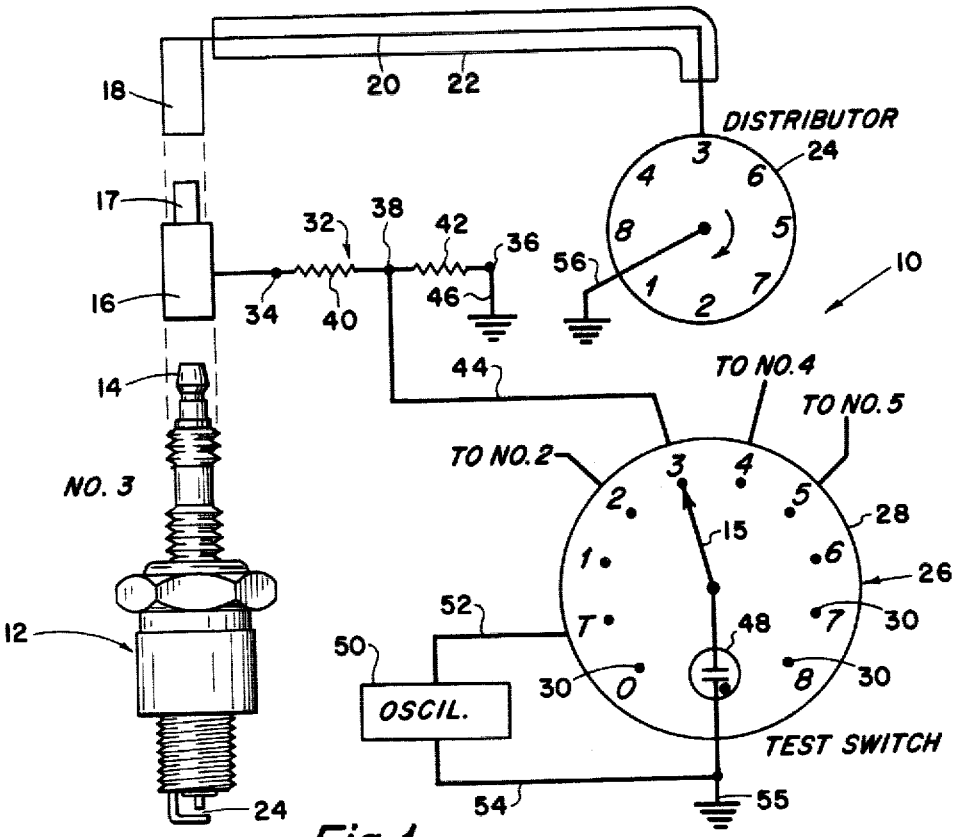
FIG. 1 is a schematic drawing of the device of this invention, as connected to the ignition system of the internal combustion engine.

Referring now to the drawings and in particular to FIG. 1 there is shown an assembly of the instrument of this invention, indicated generally by the numeral 10. It comprises a switch, indicated generally by the numeral 26, which would be mounted on the motor vehicle, probably on or below the dash board. The switch would have an insulated knob for turning the switch, so that a movable contact 15 could be positioned in contact sequently with each of a plurality of fixed contacts 30. The central movable contact 15 is connected to a gaseous conduction device 48 such as a neon tube, or a similar device, which on the application of a short time duration electric pulse, of sufficient magnitude, will provide an equally short time duration pulse of light. The brightness of the pulse of light will be a function of the voltage of the electric pulse. The other terminal of the gaseous conduction device 48 is connected by lead 55, to ground.

A spark plug is indicated generally by the numeral 12 which could be any one of the conventional spark plugs available on the market and used in motor vehicles. The central electrode 14 that goes to the spark gap 24 appears at the top of the spark plug, as terminal 14, and the conventional connector 18, which is connected by wire 20, with high voltage electrical insulation 22, to one of the outlet terminals of the distributor 25, of the engine, not shown, but well known.

Assuming that the spark plug 12 is in cylinder #3, then the connector 18 would normally be connected to the terminal 14 of the spark plug and the other end of the wire 20 would be connected to terminal #3 of the output of the distributor, and so on.

An adaptor connector 16 is provided which can be positioned on top of the terminal 14 of the spark plug, and make contact with it, while providing another terminal 17 to which the connector 18 can be connected. Thus, the potential from the distributor going by means of the conductor 20 to the terminal 18, will pass through the adaptor 17, 16, to the terminal 14 of the spark plug. With the adaptor in position, the ignition system of the engine should not be affected electrically.

A voltage divider indicated generally by the numeral 32 is connected at one end 34, to the adaptor 16 and at the other end 36, to ground by means of wire 46. The resistors 40 and 42 which make up the voltage divider have very high resistance, so that the amount of current which will flow from 20 will bypass the spark plug and flow to ground, will not reduce the spark potential substantially. Therefore it will not affect the sparking at the spark gap 24. At intermediate terminal 38 in the voltage divider 32 an insulated wire 44 is connected and goes from the voltage divider on spark plug #3, to fixed contact number #3 on the switch 26. The fixed contacts 30 are numbered corresponding to the cylinder numbers, and to the numbers on the distributor. These contacts are mounted on a insulating board 28, so that the movable contact 15 can sequentially connect to one or another of the fixed contacts. Assuming that the engine has eight cylinders there would be eight fixed contacts, each of which has a wire 44 going to the intermediate point of a voltage divider 32, which was connected between the adaptor 16 on a selected spark plug and ground.

The voltage dividing ratio of the divider 32 is such that the wire 44 will have a high enough potential when the sparking potential is supplied to conductor 20, so that the neon tube 48 will show a selected brightness of light pulse. This brightness would then represent the operation of a normal ignition system under good condition.

An electrical oscillator 50 of conventional design can be provided as an addition to this device, which would put out a time sequence of electrical pulses of a selected magnitude corresponding to that which would provide the selected brightness of the neon tube 48. This voltage is carried by conductor 52 to a terminal marked T, indicating a test terminal. When the switch contact is on this terminal T, the neon tube 48 is responding to the electrical pulses from the oscillator 50. The other terminal of the oscillator is connected by wire 54 to ground as shown. A dead contact marked O, for off is provided so that the movable contact can be positioned on that dead contact at all times except when the device is in operation.

The resistors of the potential divider 32 can be conventional high resistance resistors, which are encased in insulated casing, which may be molded, for example, around the resistors so that they have some mechanical strength. They can then be connected into position between the adaptor and a wire 46 to ground.

Alternately the voltage dividers may be connected to the individual wires 20 at the distributor. This is shown in FIGS. 2 and 3 to which references will now be made.

Figure 2:
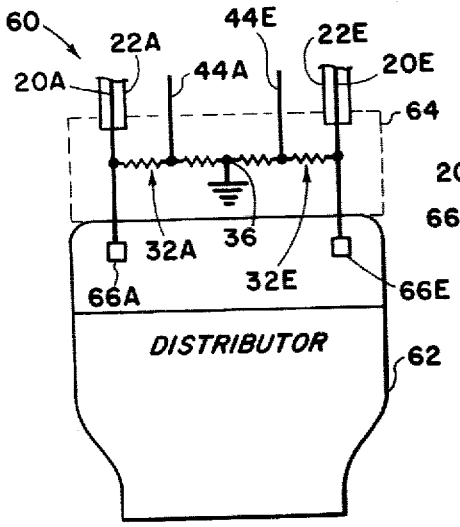
FIGS. 2 and 3 illustrate two views of the adaptor, for application to the distributor of the internal combustion engine.

FIG. 2 shows an elevation sketch, schematically, of a distributor, such as would be utilized on a conventional motor vehicle. This is indicated by the numeral 62. Such a distributor would have a plurality of outlet terminals 66 of which two 66A and 66E are shown. A small adaptor construction 64, shown in dashed outline, of insulating material can be provided to house the plurality of voltage dividers 32 such as 32A and 32E.

Figure 3:
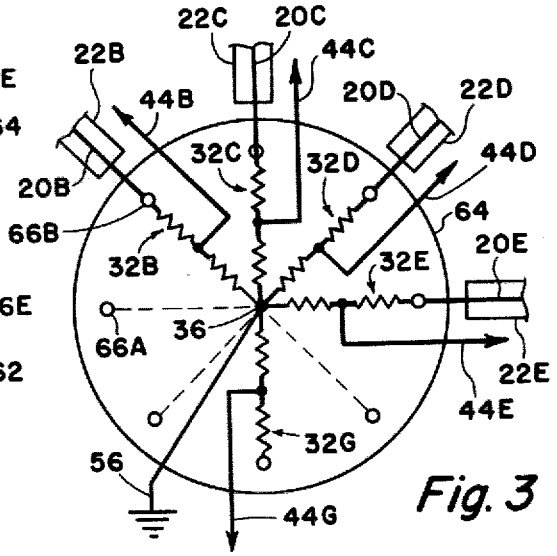

In FIG. 3 a plan view shows schematically the connection of the individual potential dividers 32B, 32C, 32D, 32E, 32G, etc. The second terminals 36 of the individual potential dividers are all connected together at the center of the star, and that point 36, is connected to ground through conductor 56. The leads 44B, 44C, 44D, 44E, etc. then connect to the individual fixed contact points, of similar number, on the switch 26 as shown in FIG. 1.

While I have called for a neon tube 48 any other type of gaseous conduction device that will respond to the electrical pulses can be used.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. In an internal combustion engine system having a plurality of separate cylinders, with a spark plug in each cylinder; and means to provide a series of synchronous spark potential pulses, selectively and sequentially, to each of said spark plugs; the improvement in self-contained, driver-operated, means to sequentially monitor the sparking condition of each spark plug, at any selected time during the operation of said internal combustion engine, comprising; in combination;

(a) at least one adaptor means to connect to the high potential terminal of at least one of said spark plugs;

(b) at least one resistive potential divider means, of high resistance, connected at a first end to said adaptor means, and at the second end to ground;

(c) first insulated electrical conductor connected at a first end to an intermediate point on said potential divider, and at the second end, to a first stationary contact on a switch means; said switch means including a movable contact adapted to make contact with said first stationary contact; and (d) gaseous conduction means connected between said moveable contact and ground, for visually monitoring the potential of the electrical pulses applied sequentially to said spark plug.

2. The apparatus as in claim 1 including N adaptor means, where N is the number of spark plugs; N resistive potential dividers, and N stationary contacts on said switch means.

3. The apparatus as in claim 1 including electrical oscillator means to produce a time sequence of electrical pulses of a selected magnitude, and means to connect said oscillator means across the terminals of said gaseous conduction means.

4. In an internal combustion engine system having a plurality of N separate cylinders, with a spark plug in each cylinder; means to provide a series of synchronous spark potential pulses; and distributor means for switching said electrical pulses selectively and sequentially to each of said N spark plugs; the improvement in self-contained, driver-operated, means to sequentially monitor the sparking condition of each said spark plug, at any selected time during the operation of said internal combustion engine, comprising, in combination;

(a) adapter-means for mounting on or near said distributor means, said adapter means having N contact means adapted to connect to the N terminals of said distributor means;

(b) a plurality of N resistive potential divider means, of high resistance, each connected at a first end to one of said N contact means on said adapter means, and at their second ends to ground;

(c) a plurality of N insulated electrical conductors each connected at a first end to a selected intermediate point on one of said potential dividers, and at the second end to a selected one of N stationary contacts on a switch means; said switch means having a movable contact adapted to make contact sequentially with each of said N stationary contacts; and (d) gaseous conduction means connected between said movable contact and ground, for usually monitoring the potential of the electrical pulses applied sequentially to each of said spark plugs.

* * * * *